US008303079B2

(12) United States Patent
Frazier et al.

(10) Patent No.: US 8,303,079 B2
(45) Date of Patent: Nov. 6, 2012

(54) SURFACE CLEANING USING A FILAMENT

(75) Inventors: Isaac S. Frazier, Sherwood, OR (US); David L. Platt, Tigard, OR (US); Debra Ranee Koehler, Sherwood, OR (US); Dan Leo Massopust, Powell Butte, OR (US)

(73) Assignee: Xerox Corporation, Norwalk, CT (US)

( * ) Notice: Subject to any disclaimer, the term of this patent is extended or adjusted under 35 U.S.C. 154(b) by 984 days.

(21) Appl. No.: 12/189,310

(22) Filed: Aug. 11, 2008

(65) Prior Publication Data

US 2010/0033532 A1 Feb. 11, 2010

(51) Int. Cl.
*B41J 23/00* (2006.01)

(52) U.S. Cl. ..... 347/33; 524/1

(58) Field of Classification Search ..... 347/33; 524/1

See application file for complete search history.

(56) References Cited

U.S. PATENT DOCUMENTS

| | | | | |
|---|---|---|---|---|
| 3,902,218 | A * | 9/1975 | Bryant | 15/250.22 |
| 4,429,032 | A * | 1/1984 | Matthe et al. | 430/231 |
| 4,578,414 | A * | 3/1986 | Sawyer et al. | 524/310 |
| 5,184,147 | A | 2/1993 | MacLane et al. | |
| 5,570,117 | A | 10/1996 | Karambelas et al. | |
| 6,460,968 | B1 * | 10/2002 | Chee et al. | 347/33 |
| 6,860,658 | B2 | 3/2005 | Tischer | |
| 6,893,110 | B2 * | 5/2005 | Plymale et al. | 347/33 |
| 2007/0212538 | A1 * | 9/2007 | Niu | 428/367 |
| 2008/0286514 | A1 * | 11/2008 | Lam et al. | 428/36.6 |

FOREIGN PATENT DOCUMENTS

EP 310202 A1 * 4/1989

* cited by examiner

*Primary Examiner* — Charlie Peng
*Assistant Examiner* — Peter Radkowski
(74) *Attorney, Agent, or Firm* — Maginot, Moore & Beck, LLP

(57) ABSTRACT

A cleaning apparatus for use in an inkjet imaging device comprises a wiper filament carriage; a wiper filament; and a filament tensioning system supported by the wiper filament carriage. The filament tensioning system is operably coupled to opposing ends of the wiper filament and configured to tension the wiper filament to form a substantially straight line therebetween.

9 Claims, 8 Drawing Sheets

SURFACE CLEANING USING A FILAMENT

TECHNICAL FIELD

This disclosure relates generally to inkjet printers, and, in particular, to cleaning systems for use in inkjet printers.

BACKGROUND

A printhead assembly of an inkjet printer typically includes one or more printheads that each have a plurality of inkjets from which drops of ink are ejected towards the recording medium. The inkjets of a printhead receive the ink from an ink supply chamber, or manifold, in the printhead which, in turn, receives ink from a source, such as a melted ink reservoir or an ink cartridge. Each inkjet includes a channel having one end connected to the ink supply manifold. The other end of the ink channel has an orifice, or nozzle, for ejecting drops of ink. The nozzles of the inkjets may be formed in an aperture, or nozzle, plate that has openings corresponding to the nozzles of the ink jets. During operation, drop ejecting signals excite actuators in the inkjets to expel drops of fluid from the inkjet nozzles onto the recording medium. By selectively exciting the actuators of the ink jets to eject drops as the recording medium and/or printhead assembly are moved relative to each other, the deposited drops can be precisely patterned to form particular text and graphic images on the recording medium.

One difficulty faced by inkjet printheads is contamination from dust or paper fibers, dried ink, etc. Inkjet printheads typically require periodic maintenance operations to remove the contamination from the nozzle plate and interior ink pathways of the printheads. Printhead maintenance generally includes purging ink through the ink pathways and nozzles of a print head assembly in order to clear contaminants, air bubbles, dried ink, etc. from the printheads. Some of the purged ink as well as any contamination or debris that has formed on the nozzle plate may collect on the nozzle plate after purging.

Several methods have been developed to remove ink and/or contamination from the nozzle plate of a printhead. One previously known method used an elastomeric or "rubber" wiper blade to wipe away ink and contamination from the nozzle plate of a printhead, similar to the way a squeegee removes fluid from a surface. While elastomeric wiper blades are effective in removing ink and debris from the nozzle plates of printheads, such wipers may require specialized materials and be expensive to manufacture. Because elastomeric wiper blades push the ink off the nozzle plate, the wiper blades may also tend to push ink and possibly debris into the nozzles. Elastomeric wiper blades may also have difficulty complying to the surface of the nozzle plate along the entire length of the nozzle plate. Areas of the nozzle plate where there is non-compliance between the wiper blade and the nozzle plate may not be cleaned adequately leaving behind streaks of ink. Also, the high coefficient of friction between the wiper blade and the nozzle plate can cause a stick-slip movement effect, where the wiper chatters during the wiping process possibly skipping over ink on the nozzle plate.

SUMMARY

A cleaning apparatus has been developed that utilizes a wiper filament, as opposed to an elastomeric wiper blade, to perform wiping operations in an inkjet imaging device. In particular, the cleaning apparatus for use in an inkjet imaging device comprises a wiper filament carriage; a wiper filament; and a filament tensioning system supported by the wiper filament carriage. The filament tensioning system is operably coupled to opposing ends of the wiper filament and configured to tension the wiper filament to form a substantially straight line therebetween.

In another embodiment, an inkjet imaging device comprises a printhead including at least one nozzle plate configured to eject ink onto an image receiving surface. The inkjet imaging device includes a wiper filament carriage; a wiper filament; and a filament tensioning system supported by the wiper filament carriage. The filament tensioning system is operably coupled to opposing ends of the wiper filament and configured to tension the wiper filament to form a substantially straight line therebetween. The inkjet imaging device also includes a wiper drive system configured to position the wiper filament carriage and the nozzle plate into an operable position with respect to each other such that the tensioned filament is positioned substantially parallel to the nozzle plate at a predetermined distance from the nozzle plate. The wiper drive system is configured to move the wiper filament carriage across the surface while maintaining the predetermined distance between the wiper filament and the nozzle plate.

In yet another embodiment, a method of operating an inkjet imaging device is provided. The method comprises positioning a tensioned filament adjacent a nozzle plate of a printhead of an inkjet imaging device, the nozzle plate having a liquid ink thereon. The tensioned filament is positioned substantially parallel to the nozzle plate at a predetermined distance from the nozzle plate. The tensioned filament is then moved across the nozzle plate while maintaining the predetermined distance between the tensioned filament and the nozzle plate. The predetermined distance is selected such that the tensioned filament contacts the liquid ink on the nozzle plate as the tensioned filament is moved across the nozzle plate.

BRIEF DESCRIPTION OF THE DRAWINGS

The foregoing aspects and other features of this disclosure are explained in the following description, taken in connection with the accompanying drawings, wherein.

DETAILED DESCRIPTION

Figure 1:
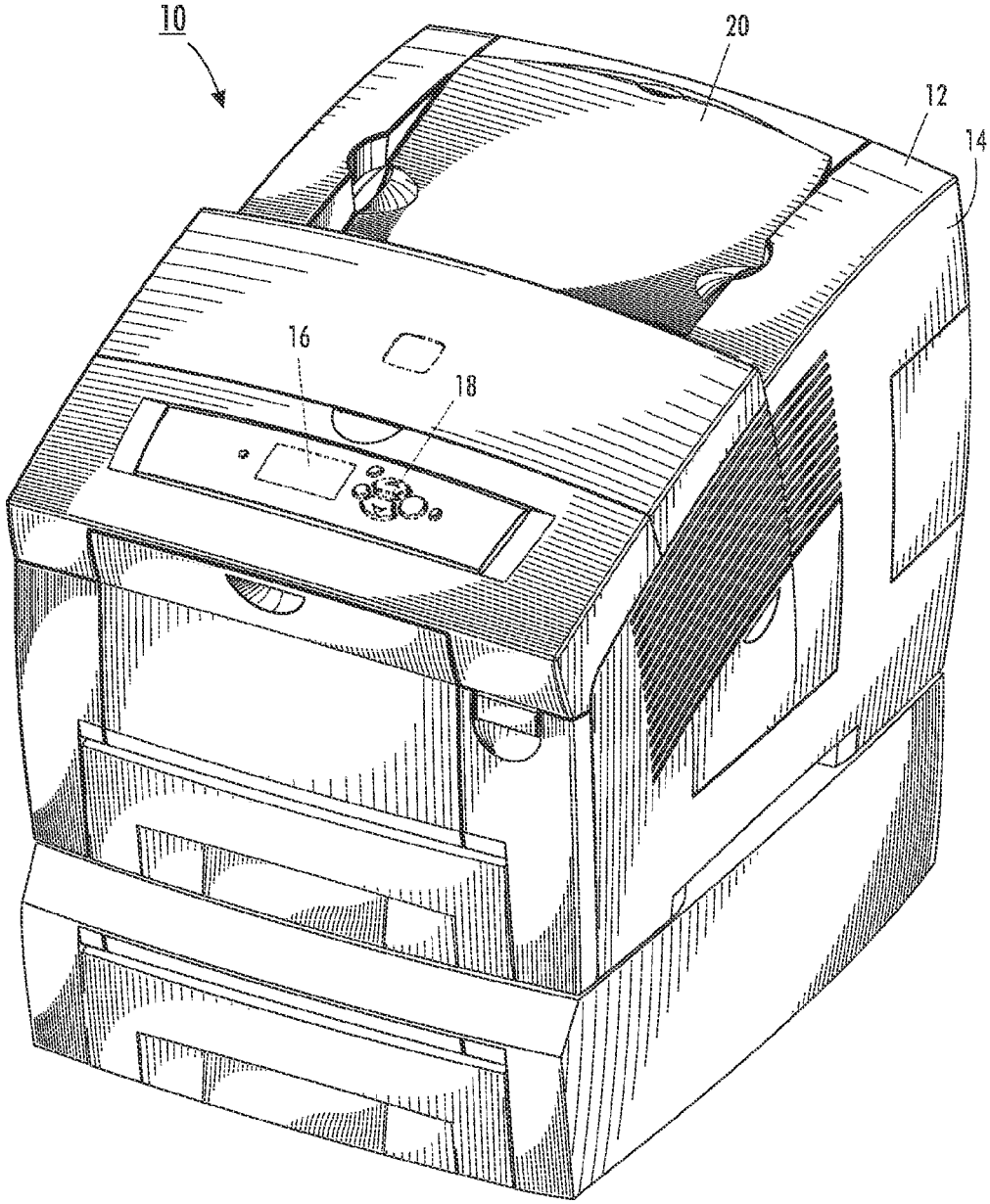
FIG. 1 PRIOR ART
FIG. 1 is a perspective view of a phase change printer with the printer ink access cover closed.

For a general understanding of the present embodiments, reference is made to the drawings. In the drawings, like reference numerals have been used throughout to designate like elements.

As used herein, the term "imaging device" generally refers to a device for applying an image to print media. "Print media" or "recording media" can be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

FIG. 1 shows an ink printer 10 that includes an outer housing having a top surface 12 and side surfaces 14. A user interface display, such as a front panel display screen 16, displays information concerning the status of the printer, and user instructions. Buttons 18 or other control actuators for controlling operation of the printer are adjacent the user interface window, or may be at other locations on the printer. An ink jet printing mechanism (not shown) is contained inside the housing. An ink feed system delivers ink to the printing mechanism. The ink feed system is contained under the top surface of the printer housing. The top surface of the housing includes a hinged ink access cover 20 that opens as shown in FIG. 2, to provide the user access to the ink feed system.

Figure 2:
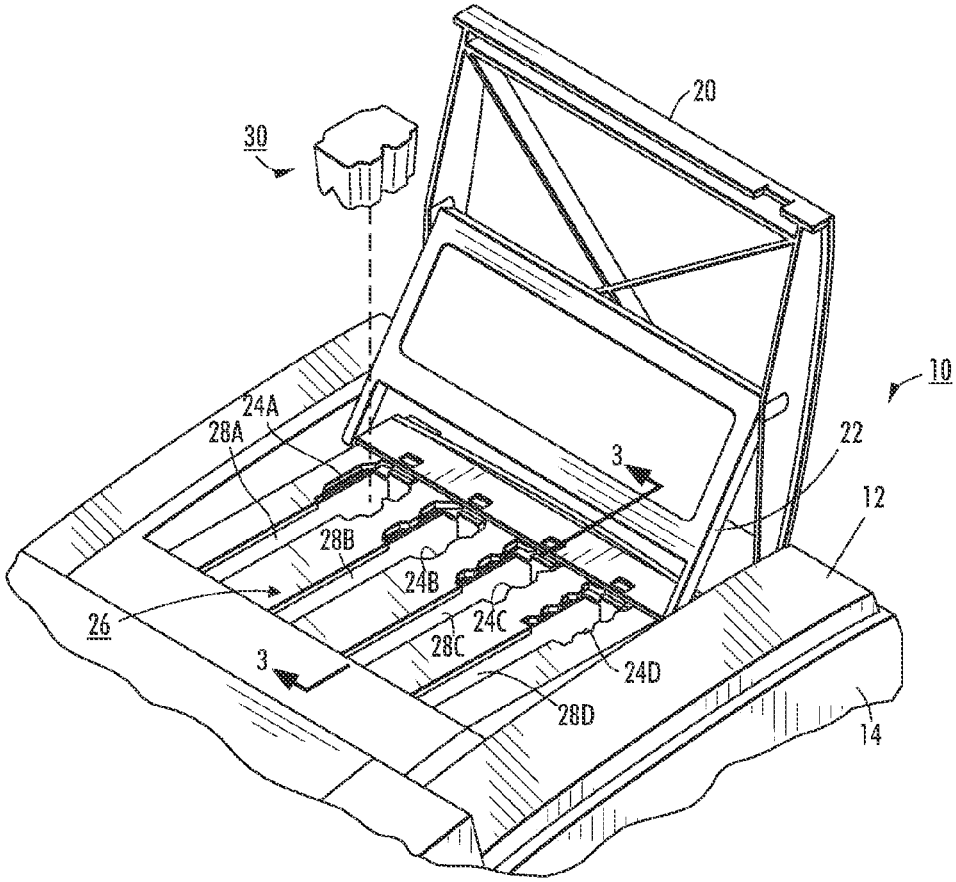
FIG. 2 PRIOR ART
FIG. 2 is an enlarged partial top perspective view of the phase change printer with the ink access cover open, showing a solid ink stick in position to be loaded into a feed channel.

In the particular printer shown in FIG. 2, the ink access cover 20 is attached to an ink load linkage element 22 so that when the printer ink access cover 20 is raised, the ink load linkage 22 slides and pivots to an ink load position. The ink access cover and the ink load linkage element may operate as described in U.S. Pat. No. 5,861,903 for an Ink Feed System, issued Jan. 19, 1999 to Crawford et al. As seen in FIG. 2, opening the ink access cover reveals a key plate 26 having keyed openings 24A-D. Each keyed opening 24A, 24B, 24C, 24D provides access to an insertion end of one of several individual feed channels 28A, 28B, 28C, 28D of the solid ink feed system.

A color printer typically uses four colors of ink (yellow, cyan, magenta, and black). Ink sticks 30 of each color are delivered through a corresponding individual one of the feed channels 28A-D. The operator of the printer exercises care to avoid inserting ink sticks of one color into a feed channel for a different color. Ink sticks may be so saturated with color dye that it may be difficult for a printer user to tell by color alone which color is which. Cyan, magenta, and black ink sticks in particular can be difficult to distinguish visually based on color appearance. The key plate 26 has keyed openings 24A, 24B, 24C, 24D to aid the printer user in ensuring that only ink sticks of the proper color are inserted into each feed channel. Each keyed opening 24A, 24B, 240, 24D of the key plate has a unique shape. The ink sticks 30 of the color for that feed channel have a shape corresponding to the shape of the keyed opening. The keyed openings and corresponding ink stick shapes exclude from each ink feed channel ink sticks of all colors except the ink sticks of the proper color for that feed channel.

Figure 3:
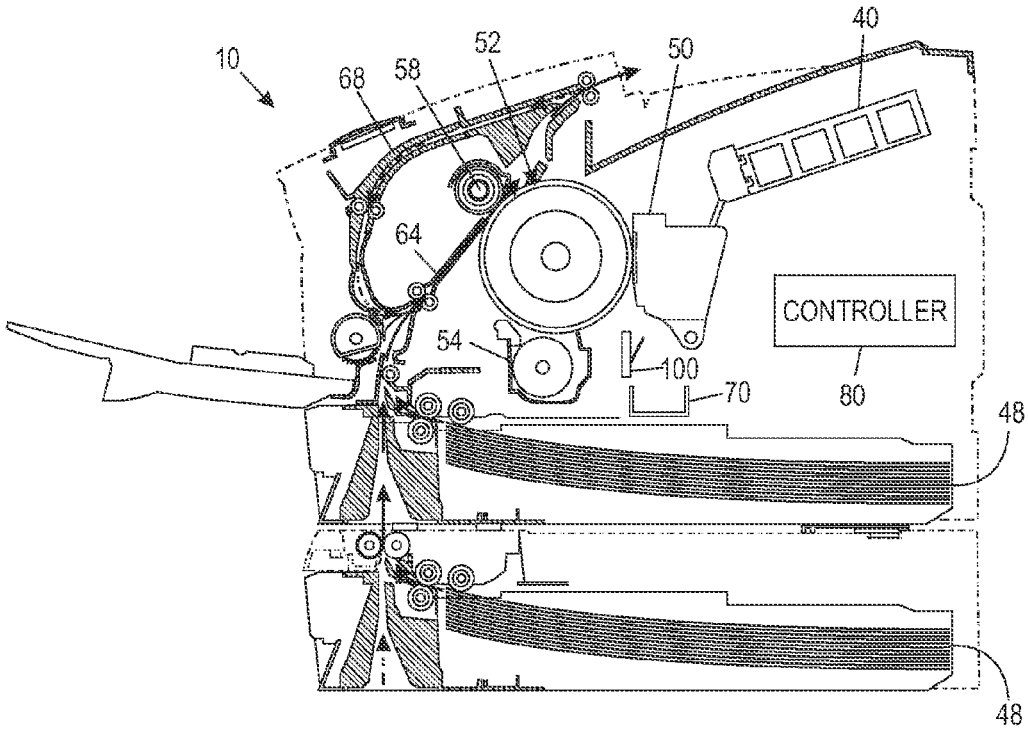
FIG. 3 is a side view of the imaging device shown in FIG. 1 depicting the major subsystems of the ink imaging device.

As shown in FIG. 3, the ink printer 10 may include an ink loading subsystem 40, one or more paper/media trays 48 (two are shown in FIG. 3), a print head 50, an imaging drum 52 having an intermediate imaging surface (not visible), a drum maintenance subsystem 54, a printhead maintenance subsystem 100, a transfer subsystem 58, a paper/media preheater 64, a duplex print path 68, and an ink waste tray 70. In brief solid ink sticks 30 are loaded into ink loader 40 through which they travel to a melting device (not shown). At the melting device, the ink stick is melted and the liquid ink is delivered to a reservoir in the print head 50. The ink is ejected by piezoelectric elements through apertures in the print head 50 to form an image on the imaging surface of the imaging member 52 as the member rotates. An imaging member heater is controlled by a controller to maintain the imaging member within an optimal temperature range for generating an ink image and transferring it to a sheet of recording media. A sheet of recording media is removed from the paper/media tray 48 and directed into the paper pre-heater 64 so the sheet of recording media is heated to a more optimal temperature for receiving the ink image. A synchronizer delivers the sheet of the recording media so its movement between the transfer roller in the transfer subsystem 58 and the image member 52 is coordinated for the transfer of the image from the imaging member to the sheet of recording media.

Operation and control of the various subsystems, components and functions of the machine or printer 10 are performed with the aid of a controller 80. The controller 80, for example, may be a micro-controller having a central processor unit (CPU), electronic storage, and a display or user interface (UI). The controller reads, captures, prepares and manages the image data flow between image sources (not shown), such as a scanner or computer, and imaging systems, such as the printhead assembly 50. The controller 80 is the main multi-tasking processor for operating and controlling all of the other machine subsystems and functions, including the machine's printing operations, and, thus, includes the necessary hardware, software, etc. for controlling these various systems.

Figure 4:
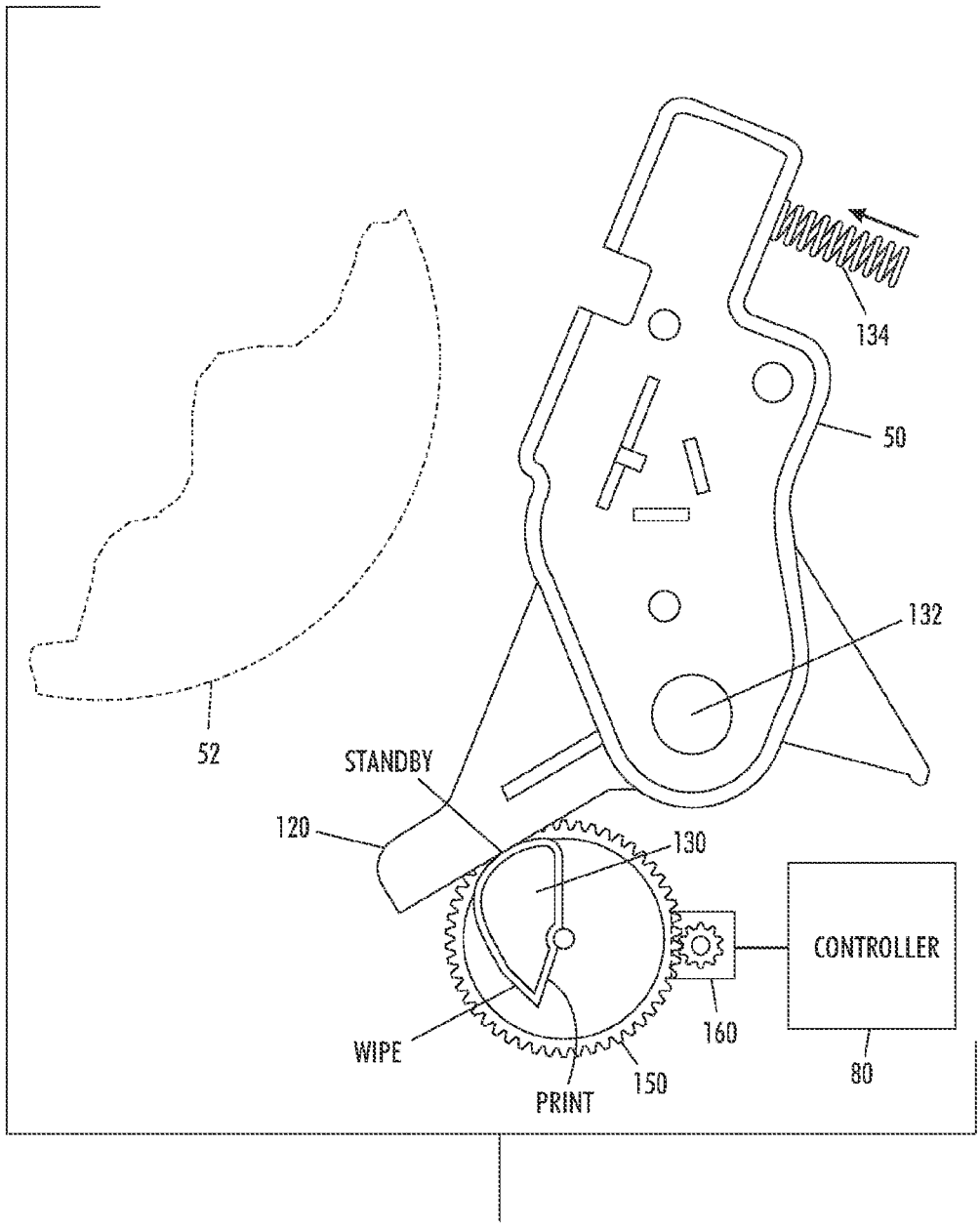
FIG. 4 is a partial side view of a printhead positioning system for use in the imaging device of FIG. 1.

As mentioned, the imaging device 10 includes a printhead cleaning apparatus 100 for periodically performing a maintenance procedure on the printhead assembly 50. To facilitate the performance of maintenance procedures, the printer may include a printhead positioning system that enables the printhead 50 to be moved into various positions, either closely adjacent to drum 52 or away from drum 52, that enables maintenance procedures such as wiping of the nozzle plate to be performed. In one embodiment, printhead movement is achieved with the use of a cam such as cam 130 and cam following arm 120 as shown in FIG. 4. In an exemplary embodiment of FIG. 4, the cam 130 includes gear train 150 to drive the cam 130 via motor 160 having mating gear teeth. An exemplary motor is a servomotor. Upon activation of drive motor 160, cam 130 rotates, which causes cam following arm 120 to move relative to the cam 130 to cause printhead 50 to pivot or tilt about a pivot shaft 132. As depicted in FIG. 4, the cam includes a Print segment, a Wipe segment, and a Standby segment which are configured to cause the printhead to tilt, via the cam following arm and pivot shaft, from the shown standby position (shown in FIG. 4) to either a wipe position or a print position. In particular, in the standby position, the cam following arm 120 moves the printhead 50 to a position that is tilted away and farthest from the drum 52. In the wipe position, the cam following arm 120 moves the printhead 50 to a position where it can be engaged with a wiping device of the printhead cleaning apparatus (not shown in FIG. 4). In the print/home position, the cam following arm 120 moves the printhead 50 close to the drum 52 so that the ink can be applied on the drum 52. In the embodiment of FIG. 4, the printhead 50 is biased about the rotational axis of the pivot shaft 132 in a direction towards the drum 52, by a biasing member or members, such as one or more head tilt springs 134. A compression spring 134 is depicted in FIG. 4. The tilt springs, however, may comprise torsion springs or any other suitable type of spring. Any suitable biasing means or method may be used to provide the biasing force to the printhead. In addition, although the printhead positioning system has been described as a cam system configured to tilt the printhead back and away from the drum into the various positions, any suitable device or method may be utilized to move the printhead between the standby, wipe, and home/print positions.

Figure 5:
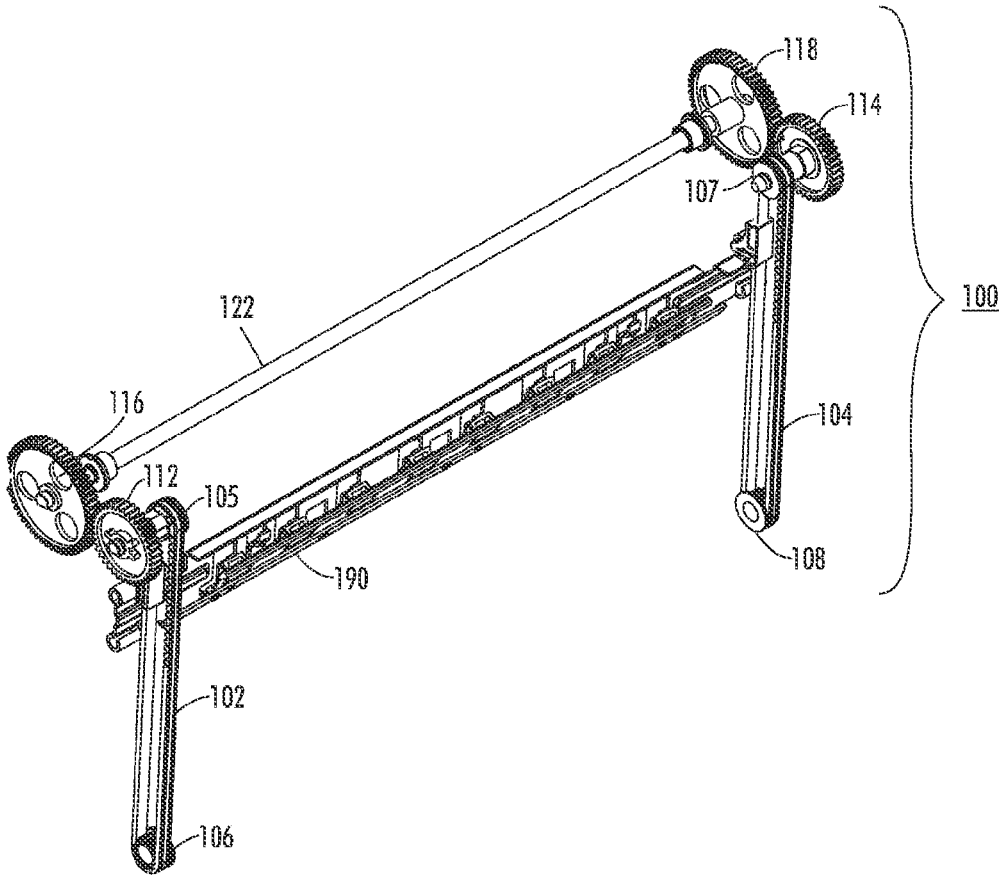
FIG. 5 is a partial perspective view of the printhead cleaning apparatus for use in the imaging device of FIG. 1.

A perspective view of the printhead cleaning apparatus 100 is depicted in FIG. 5. As shown in FIG. 5, the printhead cleaning apparatus includes a printhead wiper 190 and a wiper drive system. The printhead cleaning apparatus 100 is configured to utilize the printhead wiper 190 to wipe ink and debris from the nozzle plate of the printhead. As shown in FIG. 5, the wiper 190 is connected to, and is driven by, a pair of belts 102, 104. Each of the belts 102, 104 is extended by tension between two rollers, i.e., pulleys 105 and 106 that create the tension for belt 102, and pulleys 107 and 108 that create the tension for belt 104. Each of the pulleys 106, 108 are rotated at least substantially synchronously. The corresponding pulleys 105, 107 are connected to rotating members 112, 114, respectively and are co-rotating. Each of the rotating members 112, 114 are respectively in rotational communication with rotating members (idle gears) 116, 118. The rotating members 112, 114 are shown as gears (drive gears) in the exemplary embodiment. The idle gears 116, 118 are connected by an alignment/timing rod 122, and are co-rotating. A driving rotation which rotates either of the idle gears 116, 118 will cause the other of the idle gears 116, 118 to co-rotate through the alignment/timing rod 120 and cause rotation of their respective rotating members 112, 114; pulleys 105, 107; belts 102, 104; and pulleys 106, 108, assuring a level movement of the wiper 110.

The driving rotation may be applied to either idle gears 116, or 118, or both. In the exemplary embodiment, the driving rotation is applied to the idle gear 116. In one embodiment, the driving rotation is provided via a friction clutch (not shown) that is mounted adjacent the gear 116 which is in turn driven by the shaft of a motor assembly (not shown). However, any suitable device or method may be utilized to provide the driving rotation to the one or both of the idle gears 116, 118.

As shown in the exemplary embodiment of FIG. 5, the printhead wiper 190 is generally long and narrow and is adapted to clean the surface of the printhead of any accumulated debris or hardened ink. The wiper 190 is generally moved across the printhead (not shown in FIG. 5) during operation, contacting and cleaning the surface of the printhead in a wiping motion. The wiper 190 may be moved vertically generally from the bottom to the top or vice versa. In this exemplary embodiment, the traversing movement of the wiper 190 across the printhead is enabled by simultaneous movement of the pair of belts 102, 104. Each opposing end of the wiper 190 is attached to the respective belts 102, 104 at a predetermined portion of the belt 102, 104. The wiper 110 is attached to the belts 102, 104 so that the wiper 110 is substantially level during operation. The attachment of the wiper 190 to the belts 102, 104 may be by any suitable device currently available or later developed. The belts 102, 104 may be smooth or may have teeth. The movement of the wiper 190 may be by any other driver currently available or later developed as long as level movement of the wiper 190 is assured, and the driver need not comprise two belts, but can also be a single or a plurality of belts. In fact, any later developed system for movement of the wiper may be used.

Figure 6:
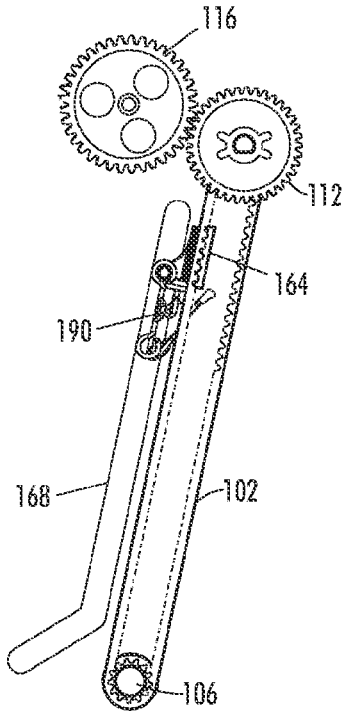
FIG. 6 is a side cross-section view of the wiper drive system for the cleaning apparatus with the printhead wiper in the wiping position.
Figure 7:
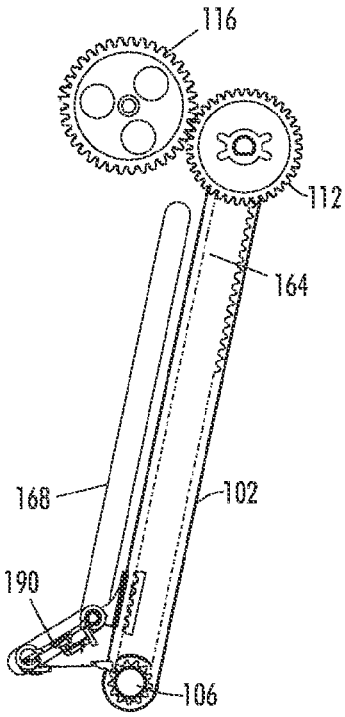
FIG. 7 is a side cross-section view of the wiper drive system for the cleaning apparatus with the printhead wiper in the home position.

FIGS. 6 and 7 depict side views of the cleaning apparatus imaging device showing the wiper 190 in its home position (FIG. 7) below the printhead (not shown in FIGS. 6 and 7) and a wiping position (FIG. 6) in which the wiper is in position to be drawn across the nozzle plate of printhead. To facilitate movement of the printhead wiper 190 from the home position to the wiping position and to ensure that the printhead wiper 190 is positioned correctly with respect to the nozzle plate of the printhead, the printer may be provided with carriage tracks 168. The carriage tracks 168 act to direct and constrain the vertical motion of the filament carriage assembly 110 so that the wiper filament is moved substantially parallel to the front face of the printhead. The ends 115, 117 (FIG. 8) of the filament carriage assembly 110 include bosses that are removably insertable into the carriage tracks 168. The filament carriage assembly 110 may attached to the belts 102, 104 by any suitable attachment device such as a clip 164 to allow the filament printhead wiper 190 to move smoothly through the curves in the vertical carriage track 168. During operation, the controller actuates the wiper drive system to move the printhead wiper 190 from the home position (FIG. 7) into the wiping position (FIG. 6) at which point the printhead may be moved from the standby position to the maintenance position so that the printhead wiper is in engagement with the face of the printhead.

Figure 8:
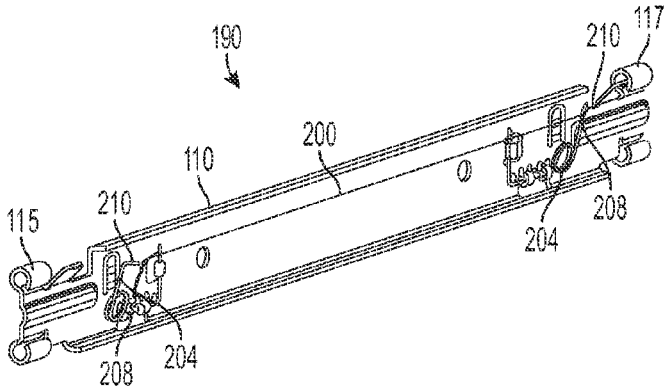
FIG. 8 is an enlarged perspective illustration of the printhead wiper and wiper filament of the cleaning apparatus of FIG. 5.

Referring now to FIG. 8, in one embodiment, the printhead wiper 190 includes a wiper filament 200, a filament carriage 110, and filament tensioning supports 204 that are supported on the carriage and configured to maintain the filament in a tensioned state. The printhead cleaning apparatus is configured to utilize the wiper filament 200 to wipe ink and debris from the face of the nozzle plate of the printhead. The wiper filament 200 is tensioned along its functional length by the tensioners 204 and is moved across the nozzle plate of the printhead 50 to pull ink and/or debris along the surface of the nozzle plate to a non-critical area of the face where the ink and/or debris no longer interferes with ink ejection from the nozzle plate. The tensioned wiper filament 200 forms a substantially straight line so that the tensioned filament has good compliance with the flat surfaces of the nozzle plates. In addition, the wiper filament 200 may have a lower coefficient of friction with respect to the nozzle plates of the printheads than a conventional elastomeric wiper blade. Accordingly, the forces that may be used to press the filament against the surface of the nozzle plates during wiping may be lower than that required for elastomeric wiper blades thereby reducing the possibility of stick-slip movement of the filament across the surface. Also, because the wiper filament is configured to draw or pull ink along the surface, rather than push the ink, the possibility of ink or debris being pushed into the nozzles during wiping is lessened.

To enhance the ability of the wiper filament 200 to remove ink from the nozzle plate of the printhead, the wiper filament is configured to have a higher surface energy than the surface energy of the nozzle plate of the printhead 50 and a lower surface energy than the surface tension of the ink. As is known in the art, surface energy refers to the ability of a liquid to wet a surface: the higher the surface energy of a solid surface, the higher the wettability of the surface. The ink used in the imaging device (e.g., phase change ink heated to a liquid state) typically has a surface tension that is high relative to the surface energy of the nozzle plate to minimize the ability of the ink to adhere to the nozzle plate during use. Liquid ink that remains on the nozzle plate having a low surface energy may be attracted to a filament having a higher surface energy as the filament is moved relative to the surface. When the filament is moved with respect to the surface, the ink is attracted more to the filament than the surface and thus adheres to the filament. In addition, because the filament has a lower surface energy relative to the surface tension of the ink, the ink adhered to the filament may attract or draw the ink on the nozzle plate along with the filament as the filament moves.

As mentioned above, the filament has a higher surface energy than the face of the printhead to enhance the ability of the filament to draw the ink across the face of the printhead. Depending on the base material used to form the face of a printhead, coatings or other surface treatments may be required for the face of the printhead in order to obtain the desired difference in surface energies. The printhead nozzle plate may be formed of a material such as stainless steel. In order to lower the surface energy of such a printhead nozzle plate, the nozzle plate may be coated with a low surface energy material such as Teflon. The wiper filament takes advantage of the surface tension of the ink and the surface energies of the filament and printhead face to improve the wiping ability of the filament. Other methods or features may be incorporated into the filament to further enhance the ability of the filament to attract ink from the nozzle plate. For example, the filament may be formed of a conductive material and given an electric charge to assist in attracting droplets of ink or fluid from the surface.

The filament has a length that is configured to span the printhead assembly so that each printhead face may be wiped during the vertical motion of the filament carriage. Moreover, the filament may have any suitable diameter that is capable of providing the wiping characteristics desired. The diameter of the filament may be dependent upon the application. For example, larger diameter filaments have more surface area to attract the ink during wiping and are stronger to resist breaking, but require more tension to make them straight. In one embodiment, the filament is formed of a polyvinylidene fluoride (PVDF) although any suitable material may be used. The filament may also be formed of multiple materials in order to better meet its requirements. For example, the filament may be formed of a very strong inner filament that does not have the desired surface energy properties with an outer coating that is formed of a less strong material that has the desired surface energy properties.

The filament carriage 110 provides a structure for supporting the filament tensioners 204 which in turn are configured to support the filament 200 in a tensioned state. The filament 200 includes attachment features 208 for attaching the ends of the filament to the tensioners. In the embodiment of FIG. 8, the attachment features 208 comprise metal crimps swaged onto the ends of the filament, and the tensioners include hooks 210 for receiving the crimped ends of the filaments. Any suitable method or device may be used, however, to attach the filament to the filament tensioners. The tensioners provide a tensioning force to straighten the filament. In the embodiment of FIG. 8, the tensioners comprise springs that are secured to the carriage. In another embodiment, the filament may be tensioned using a single tensioner spring at one end of the filament with the other end of the filament attached to a fixed point. The springs may be formed of stainless steel wire although any suitable material and/or configuration of the springs may be used. In another embodiment, the filament 200 may comprise a looped filament in which case each tensioner may include a hook or similar attachment feature for holding a portion of the looped filament such that the looped filament is pulled taut between the tensioners. In this example, one side of the looped filament may be used as the wiper filament. In addition, in this embodiment, the tensioners may include a pulley like device for rotating the filament so that different portions of the looped filament may be used to wipe the printhead nozzle plate.

The filament carriage 110 may also be configured to provide a compliant force to hold each end of the filament at a nominal proximity or gap relative to the face of the printhead during wiping and to absorb location tolerances between the movable carriage and the nozzle plate. The nominal gap between the filament and the nozzle plate during wiping may be any distance from zero in which the filament is in contract with the nozzle plate to any distance that is less than the distance that the ink extends from the surface of the nozzle plates so that the ink may bridge the gap as the filament is moved relative to the nozzle plates. The surface energy effects of the filament and the ink on the nozzle plate allow the ink on the nozzle plate to bridge the gap. In the embodiment of FIG. 8, the tensioners are configured to provide both the tensioning force as well as the compliant force. In alternative embodiments, however, the cleaning apparatus may include separate devices for providing the tensioning and compliance forces. Any suitable method or device may be used to provide the desired tension of the filament and compliance between the filament and nozzle plates.

FIG. 12 shows an exemplary wiping procedure that may be used to wipe the nozzle plate 52 of the printhead 50. As shown in FIG. 12*a*, the printhead 50 is moved into engagement with the wiper filament 200 of the printhead wiper 190 with the wiper filament 200 positioned at or near the top of the nozzle plate 52 or at least above the critical area of the nozzle plate, i.e. the area on the nozzle plate that include the nozzles for ejecting ink, as shown in FIG. 12*b*. The printhead wiper 190 is then moved substantially parallel to the nozzle plate so that the wiper filament is moved substantially from the top portion of the nozzle plate as shown in FIG. 12*b* to the bottom portion of the nozzle plate, or to a non-critical area of the nozzle plate as shown in FIG. 12*c*. As the filament contacts volumes or drops of ink 196 on the nozzle plate as shown in FIG. 12*c*, the surface energy effects between the ink 196 and the filament 200 cause the ink to be attracted to the filament 200. As the filament is moved, the ink 196 that has contacted the filament is drawn down the surface of the nozzle plate 52 to a non-critical area of the nozzle plate. When the top-to-bottom wiping of such surfaces is completed, the printhead 50 is moved from the maintenance or wipe position to the standby position to provide clearance for the wiper to be moved away from the printhead back to its home position.

The nozzle plate of the printhead is oriented substantially vertically in which case gravity may help pull the ink down to non-critical areas of the nozzle plate. The nozzle plates, however, do not have to be oriented vertically. The nozzle plates may be oriented horizontally or angled. In these embodiments, gravity may play a lesser role in the removal of ink from the nozzle plates. The cleaning apparatus may be configured with multiple filaments or to perform multiple filament wiping operations to fully clean the nozzle plates regardless of the configuration of the printheads.

The configuration described above may be partially non-contact. For example, the primary points of contact are at the ends of the filament where the filament is pressed against the nozzle plate outside of the nozzle array on the nozzle plate.

Figure 9:
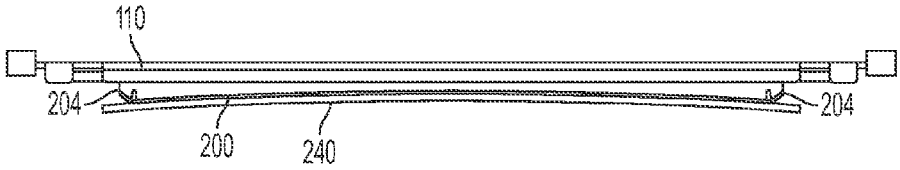
FIG. 9 is a top view of the printhead wiper and filament of FIG. 5 shown engaged with a surface bowed toward the filament.
Figure 10:
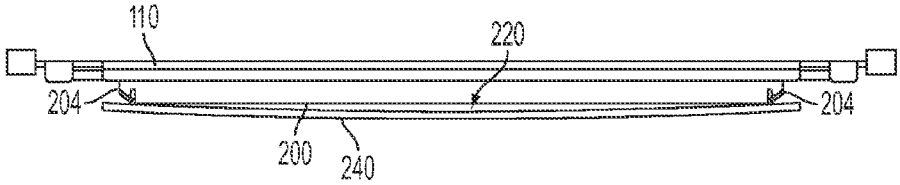
FIG. 10 is a top view of the printhead wiper and filament of FIG. 5 shown engaged with a surface bowed away from the filament.

Because the filament is tensioned, the filament forms a straight line that is compatible with the flat surfaces of the nozzle plates. Between the two contact points, the filament contacts the layer of ink on the nozzle plate as it moves down the surface, and applies very little or no force against the surface. If the surface is not perfectly flat, but instead bowed toward the filament as shown in FIG. 9, the flexible nature of the filament allows the filament 200 to comply with the surface 240 and match the surface profile, applying only a light force against the surface. If the surface 240 is bowed away from the filament, there may be a gap 220 between the intermediate portion of the filament 200 and the surface 240 as shown in FIG. 10. However, the surface energy effects between the ink, filament and surface allows the ink to bridge the gap 220 between the nozzle plate and the filament.

Figure 11:
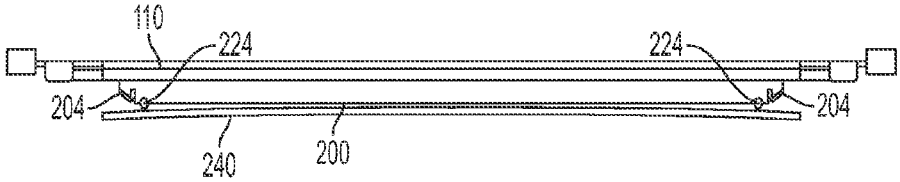
FIG. 11 is a top view of the printhead wiper and filament with spacers shown engaged with a surface.
Figure 12A:
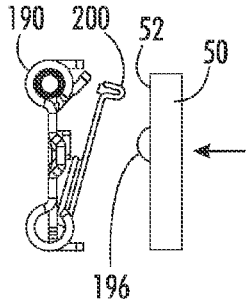
FIG. 12 is a schematic depiction of a wiping procedure utilizing the printhead wiper of FIG. 5.
Figure 12B:
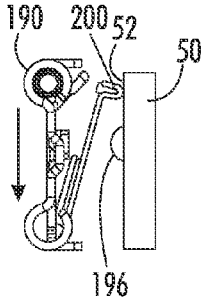
Figure 12C:
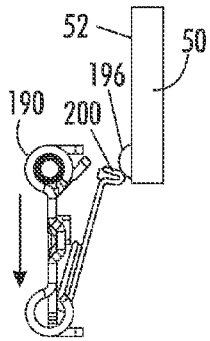
Figure 12D:
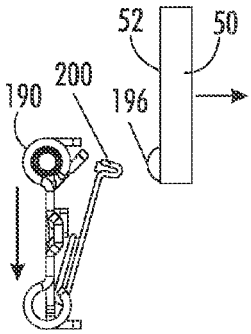

In an alternate configuration, spacers 224 may be used to intentionally create a gap between the surface 240 and the filament 200 in order to limit or prevent contact between the filament 200 and surface 240 as depicted in FIG. 11. The use of spacers 224 minimizes the effects of a bowed surface. The spacers 224 may be sized so that they exceed any potential bow of the surface, but do not exceed the distance that the ink may bridge between the filament and nozzle plate. In this embodiment, the ink must bridge the gap between the filament and the nozzle plate along the entire length of the filament. The filament, however, may pass over small droplets on the nozzle plate thereby leaving small amounts of ink on the nozzle plate. Typically, at the completion of a wipe cycle, when the nozzle plate is moved away from the filament, some amount of fluid may remain adhered to the filament. If there is adequate residual fluid on the filament at the beginning of a wipe cycle, the fluid on the filament may help bridge the gap between the surface and the filament. If the gap between the filament and surface is large enough that the residual fluid on the filament cannot bridge the gap, an alternate wiping procedure may be implemented. In the alternate wiping procedure, the filament is started at the bottom of the nozzle plate and moved toward the top of the nozzle plate. As the filament is moved up, the filament contacts drops of ink on the nozzle plate causing the ink to spread out on the nozzle plate so that areas that once had small or very thin layers of ink now includes enough ink to bridge the gap between the filament and the nozzle plate. The filament may then be moved back down the face of the printheads as described above. In another alternate embodiment, the printheads may be pressurized so that ink is pushed or bulged out of the nozzles to more easily bridge the gap or to cause ink to run down the nozzle plate where it can collect on the filament in order to bridge the gap.

The cleaning apparatus utilizing a wiper filament has been described for use with a phase change ink jet printer; however, the cleaning apparatus may also be used in other types of ink jet printers where one desires to clean the nozzle plates of a printhead. Additionally, the cleaning apparatus may be beneficial in removing fluid from substantially any flat surface. Those skilled in the art will recognize that numerous modifications can be made to the specific implementations of the cleaning apparatus described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An inkjet imaging device comprising:

a printhead including a nozzle plate configured to eject ink onto an image receiving surface;

a wiper filament carriage;

a wiper filament having a first attachment at one end and a second attachment at a second end, the wiper filament having a length between the first and the second attachment that spans a width of the printhead;

a filament tensioning system supported by the wiper filament carriage, the filament tensioning system having a first tensioner operably coupled to the first attachment and a second tensioner operably coupled to the second attachment, the filament tensioning system being configured to tension the wiper filament and form a substantially straight line with the filament that spans the width of the printhead from the first tensioner to the second tensioner and which is parallel to the nozzle plate; and a wiper drive system configured to position the wiper filament carriage into an operable position with respect to the nozzle plate such that the tensioned filament is positioned at a predetermined distance from the nozzle plate, the wiper drive system being configured to move the wiper filament carriage with reference to the nozzle plate while maintaining the length of the wiper filament from the first tensioner to the second tensioner at the predetermined distance from the nozzle plate.

2. The inkjet imaging device of claim 1, further comprising:

a printhead positioning system configured to move the printhead between at least a home position at which ink may be ejected from the nozzle plate onto the image receiving surface, a standby position that provides clearance for movement of the wiper filament to be moved in front of the nozzle plate of the printhead, and a maintenance position at which the wiper filament is drawn across the nozzle plate.

3. The inkjet imaging device of claim 2, the wiper filament having a higher surface energy than a surface energy of the nozzle plate and a lower surface energy than a surface tension of the ink.

4. The inkjet imaging device of claim 2, the wiper filament being formed of polyvinylidene fluoride.

5. The inkjet imaging device of claim 2 wherein the predetermined distance enables the tensioned wiper filament to contact the nozzle plate while the tensioned wiper filament is moved relative to the nozzle plate.

6. The inkjet imaging device of claim 2 wherein the predetermined distance provides a gap between the tensioned wiper filament and the nozzle plate, the gap being less than a distance ink can bridge from the nozzle plate to the wiper filament.

7. The inkjet imaging device of claim 6, the wiper filament including spacers positioned at opposing ends of the wiper filament, the spacers being configured to contact the nozzle plate when the tensioned wiper filament is positioned adjacent the nozzle plate to maintain the gap between the tensioned wiper filament and the nozzle plate while the tensioned wiper filament is moved relative to the nozzle plate.

8. The inkjet imaging device of claim 1, the tensioners comprising springs.

9. The inkjet imaging device of claim 1 wherein the wiper filament is a looped filament and the first tensioner and the second tensioner are hooks that engage the looped filament to enable the wiper filament to be pulled taut.

* * * * *